United States Patent [19]

Goerens

[11] 3,981,136

[45] Sept. 21, 1976

[54] EAR-SHAPED RING TRAVELERS FOR YARN TWISTERS

[75] Inventor: Robert L. Goerens, Esch sur Alzette, Luxemburg

[73] Assignee: Uniroyal, Luxembourg S.A. Luxembourg

[22] Filed: Mar. 14, 1974

[21] Appl. No.: 451,297

[30] Foreign Application Priority Data

Mar. 26, 1973 Germany ..... 2314891

[52] U.S. Cl. ..... 57/125

[51] Int. Cl.[2] ..... D01H 7/60

[58] Field of Search ..... 57/119, 120, 125

[56] References Cited

UNITED STATES PATENTS

| | | | |
|---|---|---|---|
| 631,342 | 8/1899 | Tetlow | 57/125 |
| 1,937,676 | 12/1933 | Wentworth | 57/125 |
| 2,111,544 | 3/1938 | Bassett | 57/125 |
| 2,111,545 | 3/1938 | Bassett | 57/125 |
| 2,116,071 | 5/1938 | Kempton | 57/125 |
| 2,118,873 | 5/1938 | Wentworth et al. | 57/125 |
| 2,121,647 | 6/1938 | Wentworth | 57/125 |

[30] Foreign Application Priority Data

Aug. 1956 Germany ..... 13,972

*Primary Examiner*—John Petrakes

*Attorney, Agent, or Firm*—Norbert P. Holler

[57] ABSTRACT

Generally ear-shaped ring travelers, designed for movement along the inside face of a ring of a yarn twister or like machine and having streamlined cross-sectional contours at all essential transverse cross-sectional planes C1 for minimizing acrodynamic resistance, are disclosed. The cross-sectional configuration in each section is characterized by an oblong shape having a relatively wider or blunt leading edge and a relatively narrower or less blunt trailing C2 either as a complete exposition or as a limitation of the present invention, however, the full nature and extent of the invention being discernible only by reference to and from the entire disclosure.

9 Claims, 8 Drawing Figures

EAR-SHAPED RING TRAVELERS FOR YARN TWISTERS

This invention relates to ring travelers for yarn spinning or twisting machines, and in particular to ear-shaped travelers.

Travelers for ring twisters and like machines are conventionally designated as either ear-shaped or C-shaped. By way of definition, an ear-shaped traveler is one which in use has a primarily straight main body or mid-section extending generally vertically across and traveling along the inside face of the circular ring, and two end sections extending codirectionally generally transversely to the main body section and outwardly therefrom over the top and bottom edges of the ring, respectively, and terminating in a pair of inwardly directed hook-like ends engaging the outside face of the ring to retain the traveler thereon. A C-shaped traveler, on the other hand, is one which in use has a primarily arcuate main body section extending generally horizontally across and traveling along the top edge of the ring and terminating in two inwardly directed hook-like ends engaging, respectively, under the inner and outer peripheral top edge flanges of the ring to retain the traveler on the ring.

As is well known, an ear-shaped traveler of a ring spinning or twisting machine provides, at the juncture between the main body section and the upper end section thereof, a guide eyelet which travels freely along the ring coaxially with the rotating yarn-receiving bobbin at substantially the rotational speed of the bobbin. The yarn passes through this eyelet and by virtue of the concurrent uniform up and down motion of the ring relative to the bobbin, is helically wound on the bobbin while being at the same time subjected to the desired torsion or twist. The final tension on the yarn while being wound on the bobbin is, in this process, affected by a number of factors. These include, among others, the friction between the traveler and the ring, as well as between the yarn and the traveler. This friction also leads to a substantial wear and tear of both the ring and the traveler.

In order to avoid such wear, various traveler designs and refined lubricating techniques have already been proposed. Thus, for the lubrication of an ear-shaped traveler, which, as already stated, embraces the upper and the lower ring edges, the ring has been conventionally provided with lubricating grooves or appropriately distributed small lubricating apertures, through which the lubricant is conveyed by a wicking effect or the like. Structural design variations which have been proposed have included means to displace the center of gravity of an ear-shaped traveler to the upper portion of the same so as to influence the traveling properties thereof, e.g., by extending or reinforcing the upper end section of the traveler (see for example, German Pat. No. 958,908 dated Feb. 28, 1957), and means to avoid tension-produced indentations in a metal traveler when winding yarns of certain man-made fibers at a high speed, e.g., by providing the part of the main body section of the traveler which comes into contact with the ring with a gold coating to avoid the accumulation of metal and the transmission of steel on steel at high speeds (see, for example, German OLS No. 2,224,935 dated Nov. 30, 1972).

A further structural design variation, which has been proposed especially for a C-shaped traveler, has been to make the same of synthetic, wear-resistant plastic materials (see, for example, German Pat. No. 1,004,978 dated Aug. 29, 1957). Thus, in order to ensure that such a traveler will have the required physical properties in the light of the higher tensile ratios occurring during the wet spinning of flax, hemp, and other bast fiber yarns, and at the same time to enable a desirable shifting of the center of gravity of the traveler, the same is manufactured in one piece and of synthetic plastic material, has an enlarged base or hook-like end bearing against one side of the ring, and tapers in width or cross-section from the enlarged base to the other hook-like end bearing against the other side of the ring. This construction is also intended to avoid, in addition, any depositing of dirt on the traveler in the course of the wet spinning operation, and, due to the low position of the center of gravity, the required braking of the traveler on the ring is also ensured.

Travelers of these types are suited for relatively high rotational speeds within the range of 35 and 50 m/sec. This corresponds to speeds of between about 4,500 and 6,500 revolutions per minute at a ring diameter of 150 mm. Practice has shown, however, that the maximum permissible rotational speed of the known travelers will determine and thus also limit the operating speed of the spinning and twisting machines.

It is an important object of the present invention, therefore, to provide a novel and improved ear-shaped traveler which will, solely by its design, allow considerably higher rotational speeds thereof, and thus higher operating speeds of the ring spinning or twisting machines, to be attained.

Generally speaking, the objectives of the present invention are attained by imparting to an ear-shaped traveler such a configuration that the traveler, as viewed in the normal direction of movement thereof, is characterized by streamlined cross-sectional contours and thus by minimizing air resistance in all essential transverse cross-sectional planes of the main body and end sections of the traveler. Apart from the fact that the surface of the traveler should be as smooth as possible, the configuration preferably should be such that each essential cross-section through the main body section and the upper and lower end sections of the traveler has a relatively wider or blunt leading edge (i.e., the edge facing in the normal direction of movement of the traveler) and a relatively narrower or less blunt trailing edge. Where such a cross-section is symmetrical with respect to a given dividing line extending from the leading to the trailing edge, the shape is generally drop-like and its orientation is such that the said dividing line, as viewed in the direction of movement of the traveler, is inclined to the perpendicular to the plane of the traveler in a direction away from the hook-like ends at a relatively small acute angle not greater than about 30°. For best results it is contemplated that the ratio of the length of each cross-section (the distance from the leading to the trailing edge) to the width of the section be between about 1.1:1 and about 2.5:1, and a ratio of 1.5:1 is preferred. Nevertheless, under certain circumstances somewhat greater ratios may be used so as to cause the cross-section in certain specified planes to approximate an ellipse in shape, albeit the leading edge of the section should still be more blunt than the trailing edge.

Surprisingly, it has been found that by reducing the air resistance of the traveler in this fashion, its rotational speed capability can be increased substantially over the hitherto attainable maximum rotational speed capability aforesaid. In practice, increases of up to 25% can be achieved. This results, without any need for further structural changes, in a substantial increase in the performance of otherwise conventional ring spinning and twisting machines.

The streamlined configuration designed for ensuring a low aerodynamic resistance to high speed movement of an ear-shaped traveler according to the present invention can be especially advantageously adapted for favorably influencing the effects of centrifugal force on the traveler and thereby the friction between the traveler and the ring. Thus, the cross-sectional shape may be asymmetric with respect to a given plane or longitudinal dividing line of the shape. In such a construction, the larger part of the cross-section is located on the side of that line facing inwardly of the ring. The cross-sectional shape in this case resembles that of an airfoil or airplane wing, so that even with the longitudinal dividing line of the cross-sectional configuration oriented parallel to the perpendicular to the plane of the traveler, i.e. in the direction of movement thereof, the air flowing about the main body section of the traveler can be used to exert a lifting effect thereon. Here too, however, the dividing line can be oriented at an acute angle to the perpendicular to the plane of the traveler as aforesaid.

As will be understood by those skilled in the art, the streamlined essential cross-sections hereinbefore referred to and by means of which the enhanced speed capability of the traveler is determined, are principally those of the main body section of the traveler located at the inside face of the ring. The extension of the streamlining principles of the present invention to the upper and lower end sections of an ear-shaped traveler reinforces the basic effect, however. In particular, this enables the possibility of the creation of eddies or air pockets at the ring-traversing end sections of the traveler, which could interfere with the movement of the traveler, to be efficaciously avoided.

The foregoing and other objects, characteristics and advantages of the present invention will be more clearly understood from the following detailed description thereof when read in conjuction with the accompanying drawings, in which.

Figure 1:
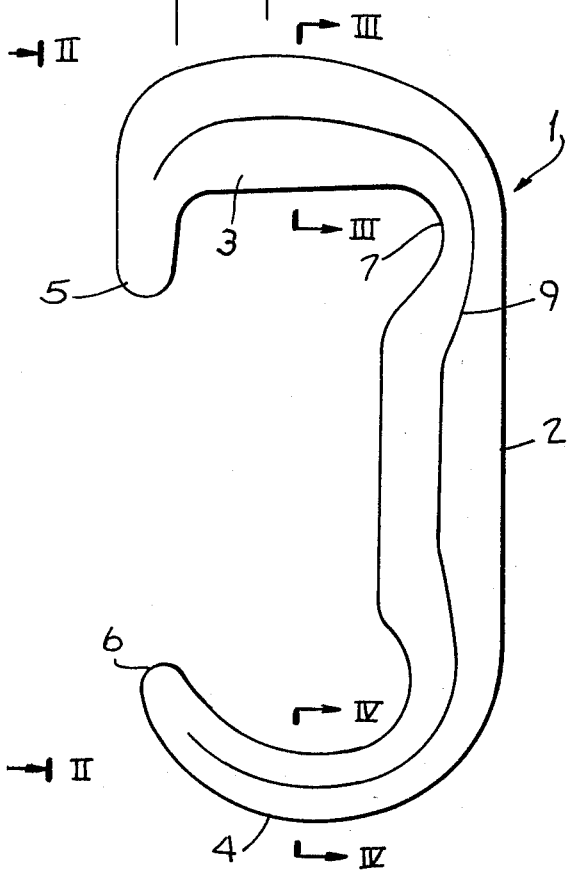
FIG. 1 is an elevational view of an ear-shaped traveler according to one embodiment of the present invention, as viewed from behind or in the normal direction of movement thereof.
Figure 2:
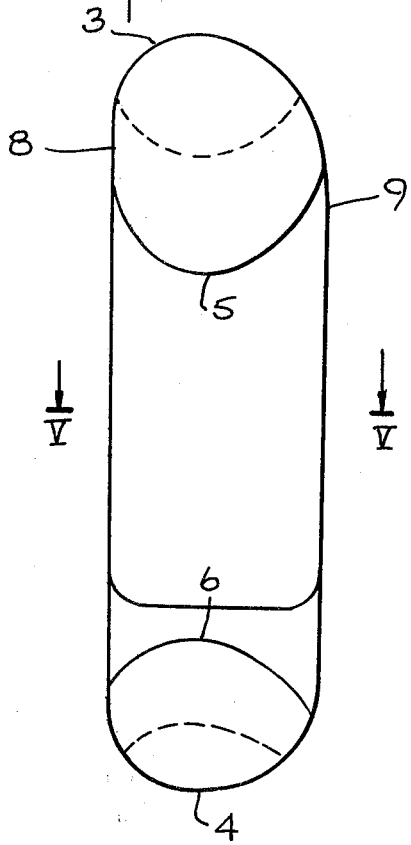
FIG. 2 is a side elevational view of the traveler shown in FIG. 1, the view being taken along the line II—II in FIG. 1.

Referring now first to FIGS. 1 to 5, the ear-shaped traveler 1 there shown has, in an essentially common plane a main body section 2 and transverse upper and lower end sections 3 and 4, the end sections terminating in respective mutually inwardly directed hook-like ends 5 and 6. At the juncture of the main body section and the upper end section, the traveler is formed with an arcuate recessed region 7 to define the space through which the yarn to be twisted will pass. The traveler is intended for a given direction of translational movement (into the plane of the paper in FIG. 1). To this end, in accordance with the basic principles of the present invention, the traveler is provided (see also FIGS. 2 to 5) with a streamlined configuration which is characterized, at all essential transverse planes, by an oblong cross-sectional shape having a relatively wider or blunt leading edge 8 (i.e., the edge facing in the direction of movement of the traveler) and a relatively narrower or less blunt trailing edge 9. Possible variants of the basic cross-sectional shape will be described more fully presently.

In use, of course, the main body section 2 of the traveler extends generally vertically across and moves translationally along the radially inner face of the ring (not shown). At the same time, the upper and lower end sections 3 and 4 extend across the upper and lower edges, respectively, of the ring, and the hook-like ends 5 and 6 engage the ring at the outside face thereof and prevent the traveler from falling off the ring.

Figure 3:
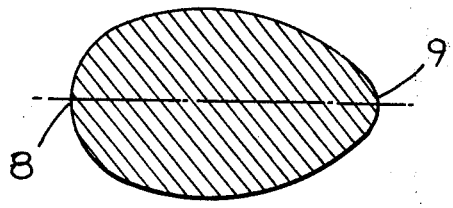
FIGS. 3 and 4 are, respectively, cross-sectional views taken along the lines III—III and IV—IV in FIG. 1.
Figure 5:
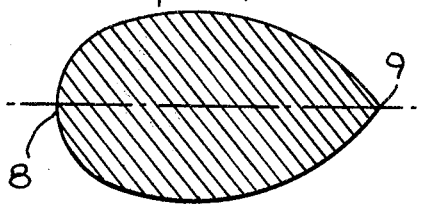
FIG. 5 is a cross-sectional view taken along the line V—V in FIG. 2.

It will be understood that all parts of any given ear-shaped traveler need not be identical in size or shape. Thus, as shown in FIGS. 3 and 5, the illustrated traveler 1 has substantially the same cross-sectional shape in both the upper end section 3 and the main body section 2, whereas in the lower end section 4 the cross-sectional shape is substantially slimmer and, although still having the relatively more blunt leading edge 8 and the relatively less blunt trailing edge 9 which are the principal characteristics of the travelers of the present invention, is approximately elliptical (see FIG. 4). In such a traveler, therefore, since the greater portion of its mass is concentrated in the upper half of the traveler, the pulling effect exerted on the traveler by the yarn passing through the eyelet section 7 is correspondingly counteracted by the greater centrifugal forces generated in the upper part of the traveler.

Figure 4:
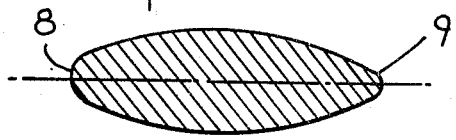

As shown in FIGS. 3 and 5, the preferred cross-sectional configuration in accordance with the present invention is a drop-like shape, but as mentioned above, the cross-sectional configuration in specific transverse planes can also have an approximately elliptical shape, as shown in FIG. 4. In the traveler 1, furthermore, the cross-sectional shape throughout is symmetrical with respect to a given longitudinal dividing line, here the center line or plane running from the leading edge 8 of the section to the trailing edge 9 thereof. It will be apparent, however, that the illustrated form of traveler will be characterized by a minimized aerodynamic resistance.

Figure 6:
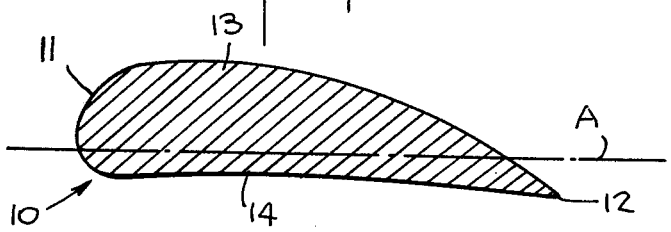
FIG. 6 is a cross-sectional view, similar to FIG. 5, of the main body section of an ear-shaped traveler according to another embodiment of the present invention.

A further counteracting influence on the centrifugal forces and on the normally high frictional forces which tend to be generated between the traveler and the ring when the former is in motion, can be effected through the use of an ear-shaped traveler in which the cross-sectional shape is asymmetrical with respect to a given longitudinal dividing line or plane of the section, with the larger portion of the section being disposed to the side of the said dividing line facing inwardly of or to the center of the ring. An example of such an arrangement is shown in FIG. 6, where the cross-sectional configuration of the traveler 10 has a shape which approximates that of an airfoil or wing profile but still has a wider or more blunt leading edge 11 and a narrower or less blunt trailing edge 12. In this traveler, the larger portion 13 of the section lies to the side of the said longitudinal dividing line or plane A facing inwardly of the ring (not shown), whereas the smaller portion 14 of the section lies to the side of this plane facing the ring, i.e., away from the center thereof. As a result, the air flowing past the traveler when the same is in motion will exert a lifting force thereon tending to hold its main body section away from the ring in opposition to the centrifugal forces tending to hold the traveler in contact with the ring.

Figure 7:
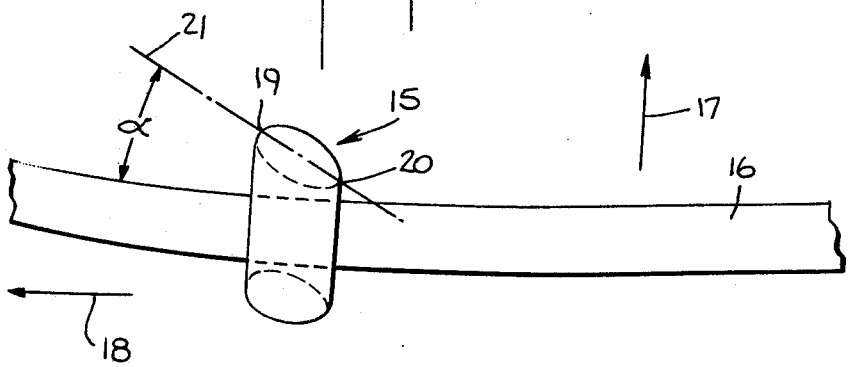
FIG. 7 is a top plan view of an ear-shaped traveler according to yet another embodiment of the present invention, an associated ring therefor being shown only schematically and in part.
Figure 8:
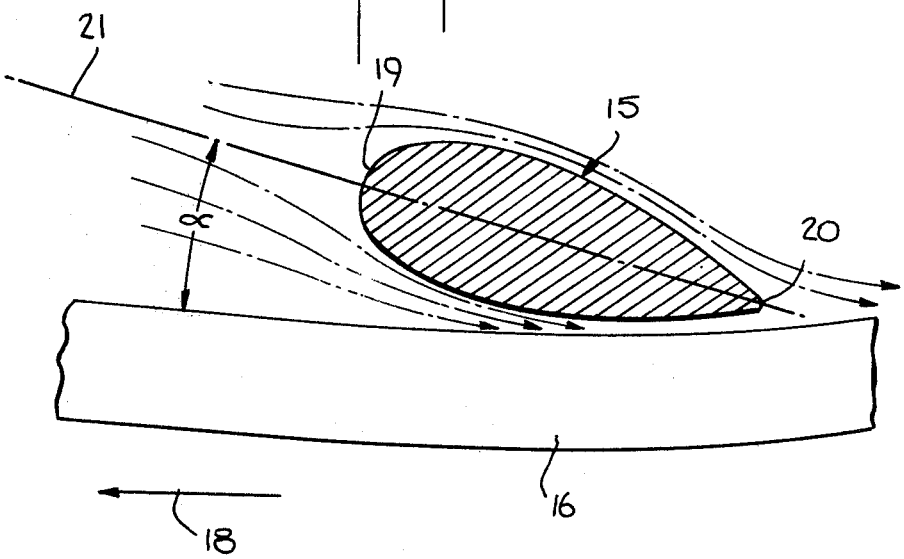
FIG. 8 is a cross-sectional view of the main body section, located within the confines of the ring, of the traveler shown in FIG. 7.

The effects of friction can also be advantageously influenced, i.e., minimized, in the case of an ear-shaped traveler having a cross-sectional configuration which is symmetrical with respect to the longitudinal dividing line or plane of the section. Referring now to FIGS. 7 and 8, a traveler 15 is there shown in operative juxtaposition to a section of the ring 16. An arrow 17 (FIG. 7) points to the center of the ring, and an arrow 18 indicates the direction of movement of the traveler along the ring. As in the embodiment of FIGS. 1 to 5, the traveler has a substantially drop-shaped cross-section with a relatively wider or more blunt leading edge 19 and a relatively narrower or less blunt trailing edge 20. The longitudinal dividing line or plane of the section is designated by reference numeral 21 and in this case is inclined to the perpendicular to the plane of the traveler in a direction away from the hook-like ends, as viewed in the direction of movement of the traveler, so as to diverge from the ring 16 inwardly thereof at an acute angle $\alpha$ not in excess of about 30° but preferably greater than about 5°. This results in an air flow around the profile surface which imparts to the traveler a buoyancy or lift directed toward the center of the ring and counteracting the centrifugal forces acting in the direction away from the center of the ring. By appropriately selecting the cross-sectional configuration and the magnitude of the angle $\alpha$, therefore, the friction between the traveler and the ring can in this manner be reliably and sensitively influenced.

It will be understood that the foregoing description of preferred embodiments of the present invention is for purposes of illustration only, and that the various structural and operational features herein disclosed are susceptible to a number of modifications and changes none of which entails any departure from the spirit and scope of the present invention as defined in the hereto appended claims.

What is claimed is:

1. An ear-shaped ring traveler designed for movement in only one given direction along a ring of a yarn twister or like machine, (a) said traveler having a main body section, first and second transverse end sections extending generally codirectionally from the opposite ends of said main body section, and first and second mutually inwardly directed hook-like ends at the extremities of said end sections, respectively, (b) of which sections, when the traveler is mounted on a ring, (i) said main body section extends generally vertically across and for movement translationally along the inside face of the ring, (ii) said first and second end sections extend generally horizontally outwardly across and for movement translationally along the upper and lower edges of the ring, respectively, and (iii) said first and second hook-like ends extend, respectively, downwardly and upwardly over and for movement translationally along the outside face of the ring, (c) said traveler having at all essential transverse planes thereof taken through said main body section perpendicularly to the longitudinal dimension of that section a streamlined cross-sectional configuration which (i) is generally oblong in shape and has, as viewed with reference to said given direction of movement, a relatively blunt leading edge and a relatively less blunt trailing edge, and, (ii) when the traveler is in use, is effective to generate aerodynamic lift forces directed inwardly of the ring so as to oppose the effects of centrifugal forces on the traveler and thereby to minimize rubbing friction between said main body section of the traveler and the inside face of the ring, (d) and said traveler further having at all essential transverse planes thereof taken through each of said end sections perpendicularly to the longitudinal dimensions of those sections, a cross-sectional configuration which (i) is generally oblong in shape and has, as viewed with reference to said given direction of movement, a relatively blunt leading edge and a relatively less blunt trailing edge, and, (ii) when the traveler is in use, is aerodynamically neutral while affording minimized air resistance.

2. A traveler as claimed in claim 1, wherein said sections and said hook-like ends of the traveler are disposed essentially in a common plane, said cross-sectional configuration of each of said sections at the respective essential transverse planes thereof is symmetrical with respect to a given longitudinal dividing line of that configuration, and said main body section is constructed and arranged to have said longitudinal dividing line of said cross-sectional configuration of said main body section, as viewed in said given direction of movement, inclined at an acute angle $\alpha$ to the perpendicular to the plane of the traveler in a direction away from said hook-like ends, whereby when the traveler is mounted on the ring, said longitudinal dividing line of said cross-sectional configuration of said main body section diverges from the inside face of the ring inwardly of the latter.

3. A traveler as claimed in claim 2, wherein the magnitude of said acute angle $\alpha$ is between about 5° and about 30°.

4. A traveler as claimed in claim 1, wherein said cross-sectional configuration of said main body section at the respective essential transverse planes thereof is generally airfoil-like in shape.

5. A traveler as claimed in claim 1, wherein said sections and said hook-like ends of the traveler are disposed essentially in a common plane, said cross-sectional configuration of said main body section at the respective essential transverse planes thereof is asymmetrical with respect to a given longitudinal dividing line of that configuration, and said cross-sectional configuration of said main body section has its larger portion located to the side of said longitudinal dividing line facing away from said hook-like ends and thereby toward the middle of the ring when the traveler is mounted on the ring.

6. A traveler as claimed in claim 5, wherein said cross-sectional configuration of each of said end sections at the respective essential transverse planes thereof is symmetrical with respect to a given longitudinal dividing line of that configuration.

7. A traveler as claimed in claim 5, wherein said main body section is constructed and arranged to have said longitudinal dividing line of said cross-sectional configuration of said main body section oriented parallel to the perpendicular to the plane of the traveler, whereby when the traveler is mounted on the ring, said longitudinal dividing line of said cross-sectional configuration of said main body section is oriented in said given direction of movement of the traveler.

8. A traveler as claimed in claim 5, wherein said main body section is constructed and arranged to have said longitudinal dividing line of said cross-sectional configuration of said main body section, as viewed in said given direction of movement, inclined at an acute angle $\alpha$ to the perpendicular to the plane of the traveler in a direction away from said hook-like ends, whereby when the traveler is mounted on the ring, said longitudinal dividing line of said cross-sectional configuration of said main body section diverges from the inside face of the ring inwardly of the latter.

9. A traveler as claimed in claim 8, wherein the magnitude of said acute angle $\alpha$ is between about 5° and about 30°.

* * * * *